US010018455B2

(12) United States Patent
Whitworth

(10) Patent No.: US 10,018,455 B2
(45) Date of Patent: Jul. 10, 2018

(54) FIREARM CLEANING SHELL

(71) Applicant: James Curtis Whitworth, Commerce Township, MI (US)

(72) Inventor: James Curtis Whitworth, Commerce Township, MI (US)

( * ) Notice: Subject to any disclaimer, the term of this patent is extended or adjusted under 35 U.S.C. 154(b) by 0 days.

(21) Appl. No.: 15/340,400

(22) Filed: Nov. 1, 2016

(65) Prior Publication Data

US 2018/0120070 A1 May 3, 2018

(51) Int. Cl.
*F42B 5/24* (2006.01)
*F42B 14/00* (2006.01)
*F42B 7/00* (2006.01)

(52) U.S. Cl.
CPC ..... *F42B 14/00* (2013.01); *F42B 5/24* (2013.01); *F42B 7/00* (2013.01)

(58) Field of Classification Search
CPC .... F42B 14/00; F42B 5/24; F42B 7/00; F42B 99/00; F42B 12/745
USPC .... 102/529, 436, 442, 502, 511, 532; 42/95, 42/106
See application file for complete search history.

(56) References Cited

U.S. PATENT DOCUMENTS 1,495,008 A * 5/1924 Feagin ..... F41A 29/00 102/442
1,830,913 A * 11/1931 Segee ..... F42B 7/04 102/449
2,765,740 A * 10/1956 Norman ..... F42B 5/24 102/442
3,476,047 A * 11/1969 Davis ..... F42B 5/24 102/442
3,762,329 A * 10/1973 Mawhinney ..... F42B 12/34 102/448
3,952,662 A * 4/1976 Greenlees ..... F42B 12/34 102/400
5,225,628 A * 7/1993 Heiny ..... F42B 5/025 102/438
5,777,258 A * 7/1998 Soon ..... F42B 5/24 102/442
6,164,209 A * 12/2000 Best ..... F42B 5/307 102/439
6,202,562 B1 * 3/2001 Brunn ..... F42B 12/34 102/293
7,131,381 B1 * 11/2006 Nafziger ..... F42B 5/24 102/444
7,150,229 B2 * 12/2006 Gardner ..... F42B 7/08 102/451
7,743,706 B1 * 6/2010 Lai ..... F42B 5/24 102/442

(Continued)

FOREIGN PATENT DOCUMENTS

WO WO-2007059527 A2 * 5/2007 ..... F42B 5/24

*Primary Examiner* — John Cooper
(74) *Attorney, Agent, or Firm* — Vincent Re PLLC

(57) ABSTRACT

An apparatus is disclosed including a bore cleaning device configured to clean a bore of a firearm. The device includes a propellant providing a force to push the projectile down the bore of the firearm, a fibrous cup, a dense material within the fibrous cup, and a frame including a bore forward disk configured to press against a bottom surface of the fibrous cup. The dense material includes one of a dense granulated material and a dense, viscous paste. The dense material is configured to deform and press radially outwardly against the cup as the propellant provides propelling force to the dense material.

10 Claims, 6 Drawing Sheets

(56) References Cited

U.S. PATENT DOCUMENTS

| | | | | |
|---|---|---|---|---|
| 8,051,776 | B1 | 11/2011 | Bailer | |
| 9,212,879 | B2 * | 12/2015 | Whitworth | F42B 14/00 |
| 9,664,487 | B2 | 5/2017 | Whitworth | |
| 2002/0129725 | A1 * | 9/2002 | Bice | F42B 5/24 102/442 |
| 2005/0252405 | A1 * | 11/2005 | Deskins | F42B 5/24 102/529 |
| 2014/0109791 | A1 * | 4/2014 | Whitworth | F42B 7/08 102/529 |
| 2014/0331886 | A1 * | 11/2014 | Whitworth | F42B 5/24 102/529 |
| 2015/0268021 | A1 * | 9/2015 | Whitworth | F42B 5/24 102/529 |
| 2016/0258705 | A1 * | 9/2016 | Whitworth | F41A 29/02 |

* cited by examiner

FIREARM CLEANING SHELL

TECHNICAL FIELD

The present disclosure relates to a device for removing material such as carbon, lead, metals, and plastic contaminants from the bore of a firearm, and more particularly relates to a projectile having a fibrous cup filled with a dense, viscous paste or granulated material, wherein the material within the cup deforms in a radial, outward direction when the projectile is fired down the bore.

BACKGROUND

The statements in this section merely provide background information related to the present disclosure. Accordingly, such statements are not intended to constitute an admission of prior art.

Cleaning the bore of a firearm after use is generally required to prevent possible damage due to corrosion to the bore. It is often true that the task of manually cleaning a firearm is most undesirable when the condition of the firearm is most suitable for bore damage; for example at the end of an outing under inclement conditions. The task of manually cleaning the bore of a firearm is time consuming and may require disassembly of the firearm. Therefore there is a need among users of firearms for a convenient, quick, easily used and effective device for cleaning a bore of moisture, powder residue and foreign material which contributes to the corrosion within a bore until a more complete manual cleaning may be accomplished.

Embodiments are known in the art to propel material down the barrel of a firearm to clean the bore of the gun. These devices, however, rely on compacted wadding to sufficiently wipe down the inner wall of the bore as they travel therethrough. To fit within a shell capable of being fired from a particular firearm inherently requires that the wadding and other materials be compacted to be smaller in rough diameter than the bore they are intended to clean. This results in an ineffectively cleaning of the bore as portions of the bore are not wiped by the intended cleaning components.

Further, these devices also generally comprise stacked layers of wadding and other materials which are either pre-moistened with a cleaner or lubricant which reduces the shelf life of product.

SUMMARY

An apparatus is disclosed including a bore cleaning device configured to clean a bore of a firearm. The device includes a propellant providing a force to push the projectile down the bore of the firearm, a fibrous cup, a dense material within the fibrous cup, and a frame including a bore forward disk configured to press against a bottom surface of the fibrous cup. The dense material includes one of a dense granulated material and a dense, viscous paste. The dense material is configured to deform and press radially outwardly against the cup as the propellant provides propelling force to the dense material.

BRIEF DESCRIPTION OF THE DRAWINGS

One or more embodiments will now be described, by way of example, with reference to the accompanying drawings, in which:

FIG. 9 illustrates bore cleaning device situated within a bore of a firearm in an unfired state;

FIG. 10 illustrates the bore cleaning device of FIG. 9 shortly after the device is transitioned to the fired state, with the metallic paste beginning to deform and press outwardly upon the cup; and FIG. 11 illustrates the bore cleaning device of FIG. 10 at some later point further down the bore.

DETAILED DESCRIPTION

Figure 1:
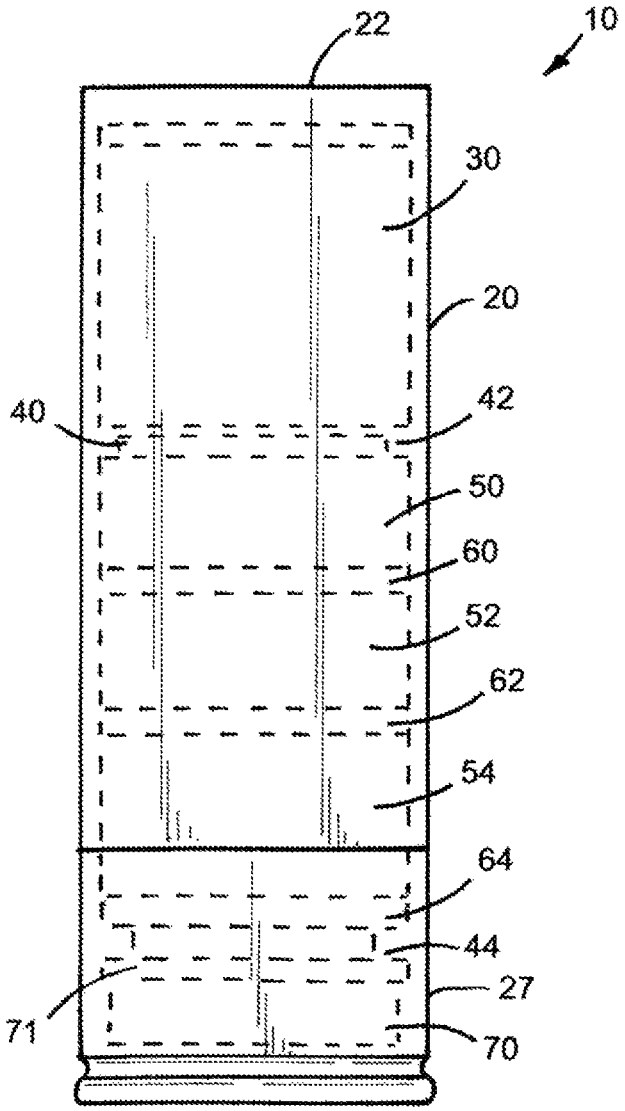
FIG. 1 illustrates an exemplary bore cleaning device in side view, in accordance with the present disclosure.

An improved bore cleaning device is disclosed, including a frame and a fibrous cup situated in a bore-forward position to the frame, wherein the fibrous cup is filled with one of a dense granular material and a dense, viscous paste/viscous liquid material or both a dense granular material and viscous paste or liquid. In a bore-rearward direction to the frame, a propellant, once ignited, provides a sudden and dramatic propelling force to the frame, which, in turn, provides a similarly dramatic force to the cup located at the bore-forward position. The dense material in the cup, being one of a dense granular material and/or a dense viscous material, upon receiving the sudden and dramatic force, tends to flatten out. As a result of the initially stationary dense material tending to stay at rest, the accelerative force applied to the dense material causes the dense material to flow in a bore-rearward direction, thereby providing a radially outward force, pushing the fibrous material into intimate contact with the inside surfaces of the bore. This intimate contact between the fibrous cup and the inside surfaces of the bore, as the cup is being forced down the bore, wipes the inside surface of the bore, with contaminants being loosened and swept along the bore with the fibrous cup.

The fibrous cup can be used in isolation of other cleaning surfaces on the projectile, with the cup being the only cleaning surface in contact with the inside of the bore. In another embodiment, the frame can include additional cleaning features that continue to wipe the inside surface of the bore as the frame follows the fibrous cup down the bore. In one exemplary construction, the frame can include a disk at one terminal end of the frame, another disk at the other terminal end of the frame, and legs connected between the disks, wherein the legs are configured to bend when a propulsive force is applied to one of the disks. By wrapping or placing cleaning materials, such as scrubbing or wiping materials, around the legs that are configured to bend, the bending legs can include an outward/radial displacement that forces intimate contact between the cleaning materials and the inside of the bore.

Cleaning materials that can be wrapped or placed around the bending legs can include disk or cylinder shaped cleaning materials. One exemplary scrubbing material can be a fibrous pad rigid enough to hold its form when no propelling force is acting upon the scrubbing material and yet pliable enough to expand outwardly/radially by an exemplary 1-8 mm when acted upon by the bending legs.

A disk shaped or cylindrically shaped scrubbing pad can have a hole in the center for the bending legs, in an unbent or resting state, to be inserted therethrough in an assembly process for the projectile. In another embodiment, the scrubbing pad can additionally include a longitudinal slot, so that the scrubbing pad can be fitted through the slot over the bending legs. In one embodiment, the scrubbing material can be formed with an outer shape of a cylinder. In one embodiment, wherein the projectile is configured for use in a firearm having a rifled barrel, a plurality of longitudinal slots or notches can be cut in the outer surface of the cylindrical shape. These outwardly facing slots or notches form small corners in the material, permitting the scrubbing pad material in the small corners to penetrate into recesses in the rifling that would normally not be reached by a cylindrical pad without the notches or slots.

Referring now to the drawings, wherein the showings are for the purpose of illustrating certain exemplary embodiments only and not for the purpose of limiting the same, FIG. 1 illustrates an exemplary bore cleaning device in side view. Bore cleaning device 10 includes shell case 20 and brass head or casing 27. Bore cleaning device 10 includes an exemplary device configured to imitate a shotgun shell and clean the bore of a shotgun, which can include a smooth bore (for example, used with bird shot) or a rifled bore (for example, used with a rifled deer slug.) It will be appreciated that a similar device using embodiments of the disclosed device can be configured for use in an exemplary 9 mm handgun or an exemplary 0.223 caliber rifle, and the disclosure is not intended to be limited to the particular shotgun configuration in the illustrated embodiments. Viewed from the outside, device 10 including shell case 20 and brass head 27 can look very similar to a shotgun shell of the same caliber as ammunition for the same firearm to be cleaned. In another embodiment, shell case 20 can be transparent or translucent, both for aesthetic or marketing purposes and/or to prevent a user from confusing the bore cleaning device with live ammunition.

Internal components of bore cleaning device 10 are illustrated with dotted lines. Shell case end portion 22 includes material of shell case 20 pressed into an end similar to ends of ammunition rounds, the end portion 22 holding the components of device 10 within shell case 20 until the device is fired or activated within a firearm. Components of the device include fibrous cup 30, frame 40, cleaning materials 50, 52, 54, 60, 62, and 64, and propellant 70. Frame 40 includes a first disk 42, a second disk 44 longitudinally containing the cleaning materials therebetween.

Figure 2:
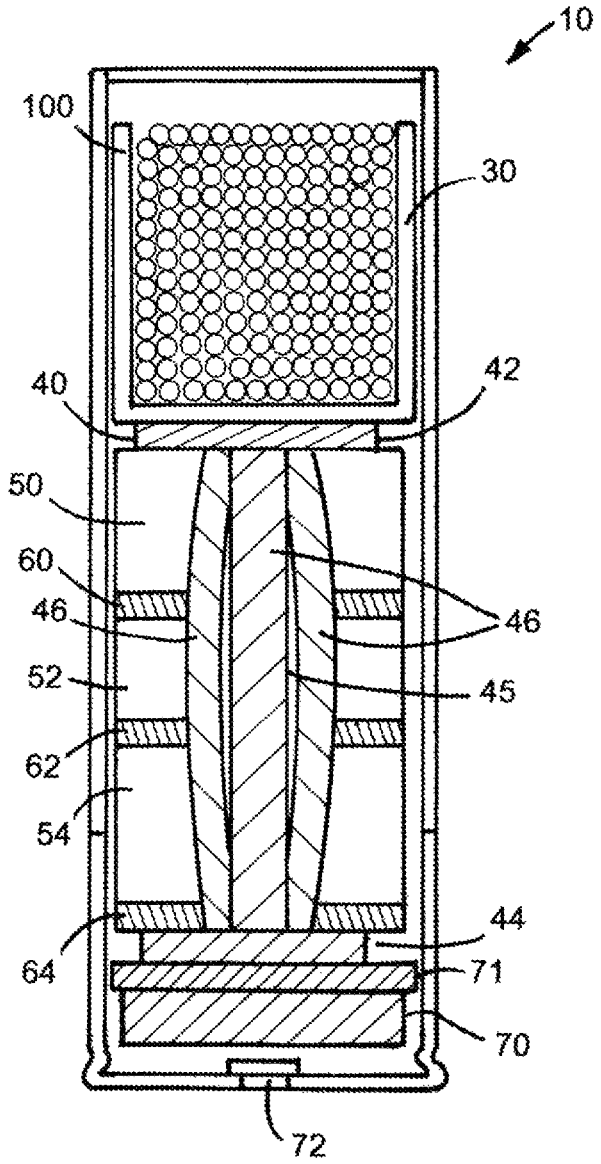
FIG. 2 illustrates the bore cleaning device of FIG. 1 in cross-section, in accordance with the present disclosure.

FIG. 2 illustrates the bore cleaning device of FIG. 1 in cross-section. Bore cleaning device 10 includes fibrous cup 30 filled with dense, granular material, frame 40, cleaning materials 50, 52, 54, 60, 62, and 64, gas seal 71, propellant 70, and primer 72. Primer 72 is configured to provide a spark to propellant 70 when the primer is struck by a firing pin. Propellant 70 can include gunpowder, although some types of gunpowder are not ideal as they can introduce contaminants to the inside of the bore as the device is propelled through the bore. Propellant 70 can include chemical compositions known in the art configured to rapidly or explosively expand as a spark is introduced.

Fibrous cup 30 is a cup constructed of fibrous material. The material can include fibrous paper, recycled material, high temperature resistant material (capable of withstanding excess of 400 degrees F. or 200 degrees C.) and/or a durable/flexible tapered cup. The material can be selected to avoid condensation within the device. Cup 30 is filled with a dense granular and/or dense viscous material. Exemplary dense materials can include but are not limited to lead, zinc, iron, copper, colloidal suspensions, and metallic or ceramic pastes. Dense materials useful for the disclosed device ideally deforms as the device 10 transitions from an unfired state in the chamber of a firearm to a fired state speeding down the bore of the firearm. This deformation is created by the inertial forces inherent to the dense material. The dense material needs to deform in a rearward bore direction in relation to the cup, such that the deforming material pushes in a radially outward direction, pushing the fibrous cup against the inner surface of the bore of the firearm. This radially outward force against the cup forces the fibrous material of the cup to create intimate contact with the bore, such that the fibrous material scrubs and loosens debris from the inner surface of the bore.

Cup 30 of FIG. 2 is filled with exemplary lead spheres 100, each roughly 0.8-1.5 mm thick. Spheres of this size enable the spheres 100 to move easily against each other such that the required deformation is achieved. Larger spheres would fail to flow against each other and would act more like a solid weight in cup 30, which would fail to cause intimate contact between the cup and the bore. Smaller spheres would tend to displace within the device, falling out of the cup and down the sides of the device, thereby making spheres 100 ineffective for the required deformation and outward force upon cup 30.

Device 10 can include a rigid frame that is primarily configured to transfer force from expanding propellant 70 to cup 30. In the embodiment of FIG. 2, frame 40 includes a first disk 42, a second disk 44, and four legs 46 connecting the two disks 42 and 44. Legs 46 are defined by open slot 45 between the legs. Legs 46 are configured such that when the propellant provides a strong propelling force upon disk 44, the frame 40 is compressed and legs 46. As legs 46, they extend sideways or in a radially outward direction in relation to the inside surface of a bore of a firearm. Cleaning materials 50, 52, 54, 60, 62, and 64 are wrapped or positioned around legs 46. As legs 46 bend and push radially outward, the cleaning materials are pushed against the inside surface of the bore of the gun. When second disk 44 is narrower than the bore of the firearm to be cleaned, a charge plug 71 can be added to seal behind the frame 40 and provide a surface for the force of the propellant to push against. In one embodiment, two legs 46 are formed with disk 42, and two legs are formed with disk 44, and the disks each include small cavities configured to receive small snapping features on the ends of the legs of the other disk.

Figure 3:
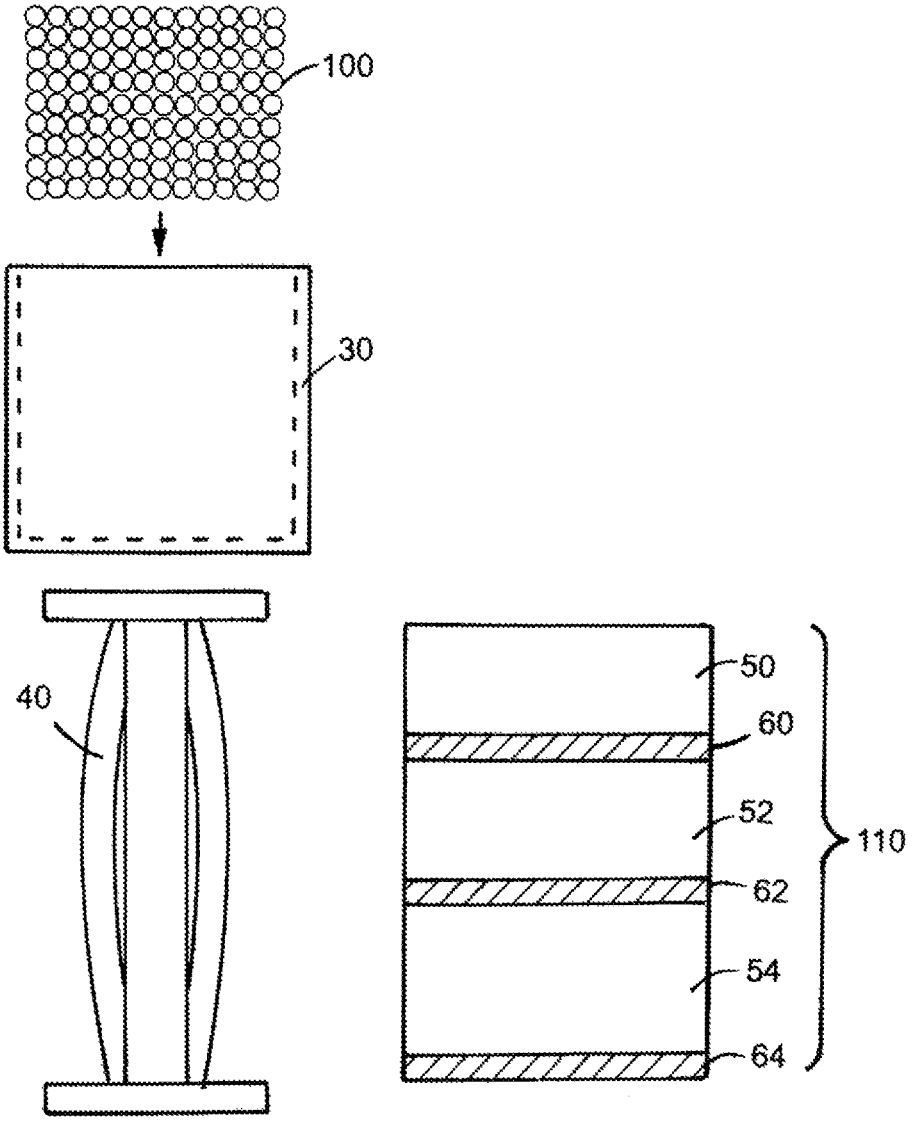
FIG. 3 illustrates the components of the bore device of FIG. 2 removed from the shell case, in accordance with the present disclosure.

FIG. 3 illustrates the components of the bore device of FIG. 2 removed from the shell case. Lead spheres 100 are illustrated ready to be provided within cup 30. Frame 40 is illustrated, with cleaning materials 110 including fibrous cylindrically shaped pads 50, 52, and 54 and rubberized wiper disks 60, 62, and 64 removed from frame 40.

Figure 4:
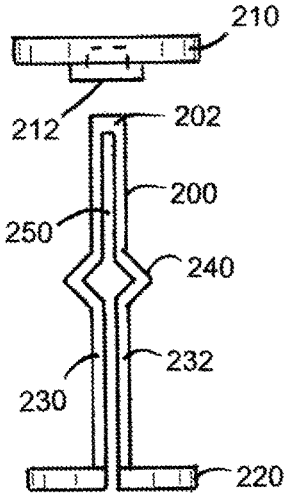
FIG. 4 illustrates an alternative frame to the frame of FIG. 3, in accordance with the present disclosure.

FIG. 4 illustrates an alternative frame to the frame of FIG. 3. Frame 200 is illustrated including frame body 201 and a separable forward disk 210. Frame body 201 includes rearward disk 220 and bending legs 230 and 232. Bending legs 230 and 232 are defined by slot 250 therebetween and knee portions 240. Frame body 201 include forward end 202 configured to be inserted within receiving cavity 212 of forward disk 210. With forward disk 210 installed to frame body 201, frame 200 functions similarly or identically to frame 40 of FIG. 3. Rearward disk 220 can be a solid round disk. In the exemplary embodiment of FIG. 4, rearward disk 220 can be segmented in two half circles, such that the split between the two half circles helps the connected legs 230 and 232 to widen more easily when the propelling force is applied.

Figure 5:
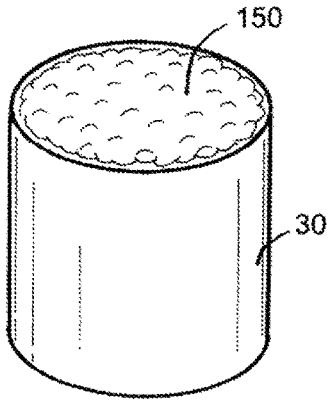
FIG. 5 illustrates a fibrous cup filled with an exemplary alternative dense material, such as a metallic paste, in accordance with the present disclosure.

FIG. 5 illustrates a fibrous cup filled with an exemplary alternative dense material, such as a metallic paste. Cup 30 is filled with a metallic paste which is dense, with a similar density to lead or a similar material. The paste is viscous, meaning that it includes a flow resistance, but it is not so viscous that it will not deform when fired down the bore of a firearm.

Figure 6:
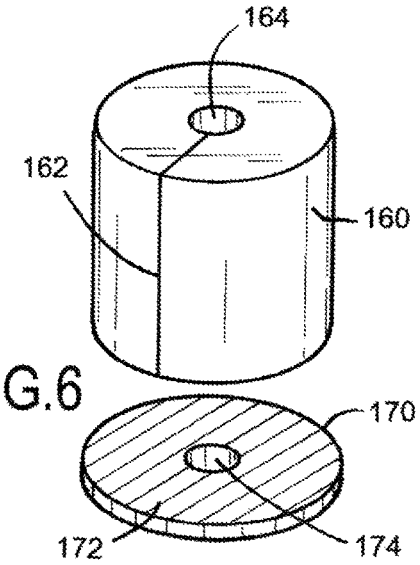
FIG. 6 illustrates exemplary cleaning materials including slots cut from a center hole to an outer surface and configured to be installed to bending legs of a frame, in accordance with the present disclosure.

FIG. 6 illustrates exemplary cleaning materials including slots cut from a center hole to an outer surface and configured to be installed to bending legs of a frame. Fibrous pad 160 is formed in the shape of a cylinder. Pad 160 includes center hole 164 and slot 162 connecting center hole 164 to an outside surface of pad 160. Rubberized wiper disk 170 is illustrated including center hole 174 and slot 172 connecting center hole 174 to an outside surface of wiper 170. Slots 162 and 172 are configured such that pad 160 and wiper 170, respectively, can be slid over bending legs of a frame.

Figure 8:
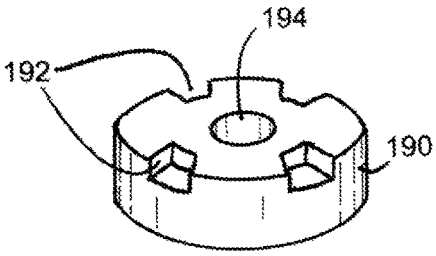
FIG. 8 illustrates a fibrous pad including notches cut in an outer surface of the pad to facilitate cleaning of a rifled bore, in accordance with the present disclosure.
Figure 7:
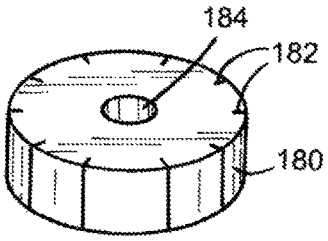
FIG. 7 illustrates a fibrous pad including slots cut in an outer surface of the pad to facilitate cleaning of a rifled bore, in accordance with the present disclosure.

FIG. 7 illustrates a fibrous pad including slots cut in an outer surface of the pad to facilitate cleaning of a rifled bore. Fibrous pad 180 includes center hole 184. Slots 182 are illustrated around a perimeter of pad 180 but do not cut all the way through the material of pad 180, such that the pad remains intact. FIG. 8 illustrates a fibrous pad including notches cut in an outer surface of the pad to facilitate cleaning of a rifled bore. Fibrous pad 190 includes center hole 194. Notches 192 are illustrated around a perimeter of pad 190 but do cut all the way through the material of pad 180, such that the pad remains intact.

Figure 9:
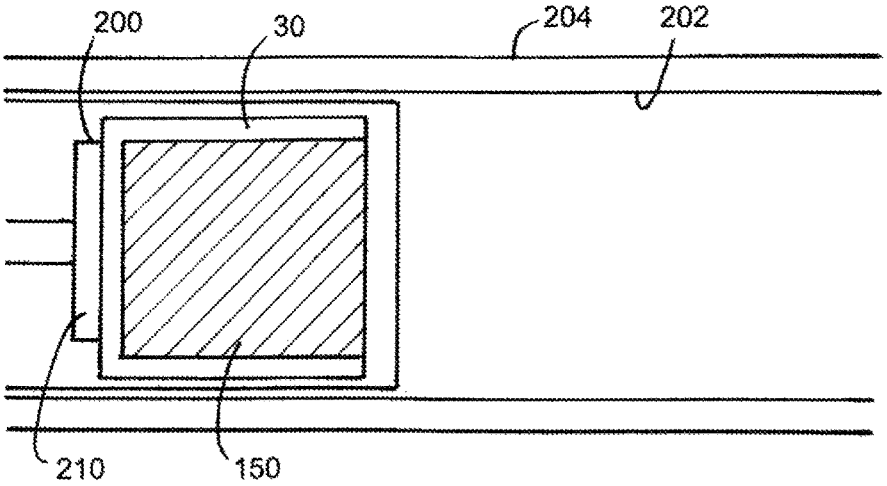
FIGS. 9-11 are illustrated in cross-section, showing a bore cleaning device being propelled down the bore of a firearm, in accordance with the present disclosure.
Figure 10:
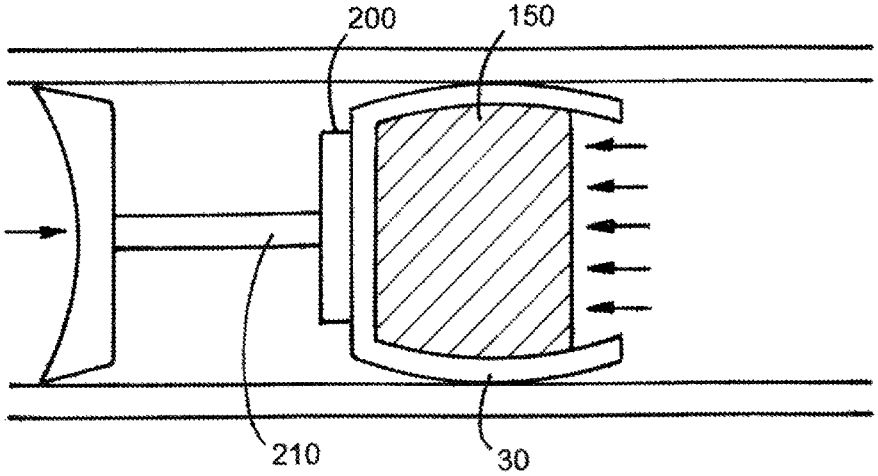
Figure 11:
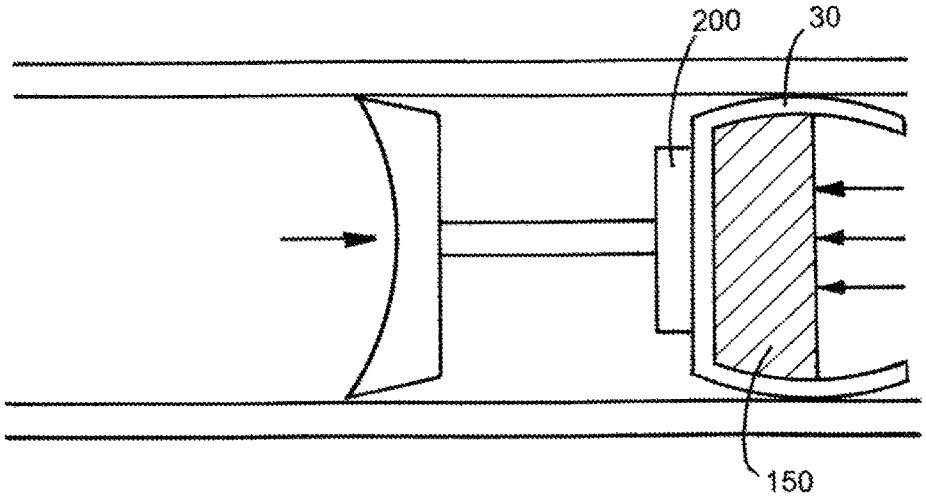

FIGS. 9-11 are illustrated in cross-section, showing a bore cleaning device being propelled down the bore of a firearm. FIG. 9 illustrates bore cleaning device 200 situated within bore 202 of firearm 204 in an unfired state. Device 200 includes rigid frame 210, cup 30, and metallic paste 150 within cup 30. FIG. 10 illustrates the bore cleaning device of FIG. 9 shortly after the device is transitioned to the fired state, with the metallic paste beginning to deform and press outwardly upon the cup. Bore cleaning device 200 includes rigid frame 210 and cup 30 filled with metallic paste 150. Very rapid acceleration of device 200 down bore 202 deforms paste 150 such that surface 152 of paste 150 moves in a bore rearward direction in relation to cup 30. This rearward deformation of paste 150 forces the paste to push radially outwardly against cup 30, such that cup 30 is pressed against bore 202. FIG. 11 illustrates the bore cleaning device of FIG. 10 at some later point further down the bore. As the bore cleaning device 200 continues to accelerate down bore 202, paste 150 continues to deform, surface 152 continues to move in a bore rearward direction relative to cup 30, and paste 150 continues to create an outward force, pushing cup 30 against bore 202.

Figure 12:
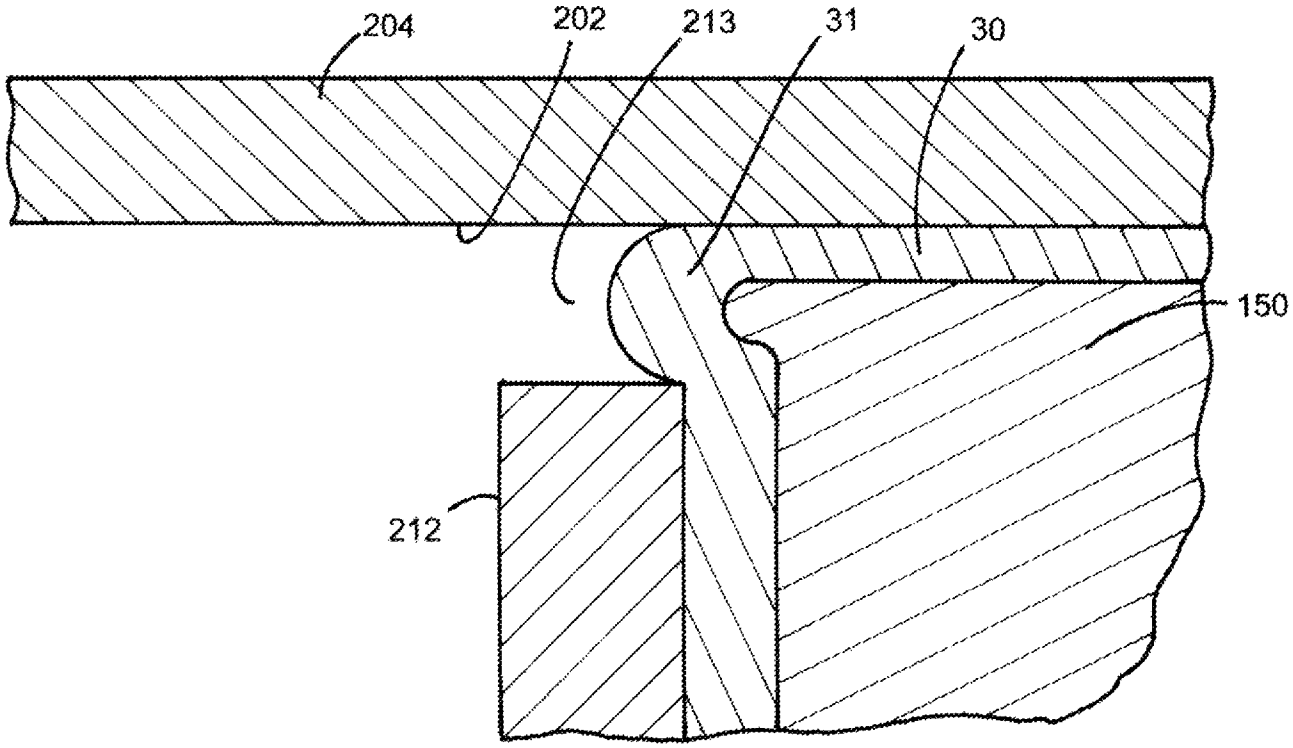
FIG. 12 illustrates an optional construction including interaction between the cup and the frame of FIG. 11 with increased scale, showing an exemplary frame including a narrow bore forward disk enabling the cup to bend backward into a gap between the disk and the surface of the bore, in accordance with the present disclosure.

FIG. 12 illustrates an optional construction including interaction between the cup and the frame of FIG. 11 with increased scale, showing an exemplary frame including a narrow bore forward disk enabling the cup to bend backward into a gap between the disk and the surface of the bore. Firearm 204 is illustrated including bore 202. Bore forward disk 212 of frame 210 of FIG. 11 is illustrated, wherein the disk is narrower in diameter than the diameter of bore 202. As a result, gap 213 exists between the surface of bore 202 and disk 212. Dense paste 150 is contained within fibrous cup 30. As the device moves down bore 202, the dense paste 150 pushes material of the fibrous cup 30 into a curved backward portion 31. It will be appreciated that by permitting portion 31 to curve backward into gap 213, the gap being created by using a bore forward disk with a diameter substantially less than the bore of the firearm, the scrubbing force applied by cup 30 against the surface of bore 202 can be increased.

Frames for the present device can be constructed of many different materials, including but not limited to polyethylene and other common plastics.

The disclosure has described certain embodiments and modifications of those embodiments. Further modifications and alterations may occur to others upon reading and understanding the specification. Therefore, it is intended that the disclosure not be limited to the particular embodiment(s) disclosed as the best mode contemplated for carrying out this disclosure, but that the disclosure will include all embodiments falling within the scope of the appended claims.

The invention claimed is:

1. An apparatus comprising a bore cleaning device configured to clean a bore of a firearm, the device comprising:

a propellant providing a force to push the bore cleaning device down the bore of the firearm;

a fibrous cup;

a dense granulated material within the fibrous cup, wherein the dense granulated material is configured to deform and press radially outwardly against the cup as the propellant provides propelling force to the dense material; and a frame comprising a bore forward disk configured to press against a bottom surface of the fibrous cup, wherein the bore forward disk is narrower than a diameter of the bore of the firearm such that a gap exists around a circumference of the bore forward disk between the bore forward disk and the bore of the firearm, the gap being configured to enable the fibrous cup to deform into the gap as the bore cleaning device moves down the bore.

2. The apparatus of claim 1, wherein the dense material comprises metallic spheres.

3. The apparatus of claim 2, wherein the metallic spheres are constructed with lead.

4. The apparatus of claim 2, wherein the metallic spheres each have a diameter of 0.8 mm to 1.5 mm.

5. The apparatus of claim 1, wherein the forward disk comprises a diameter less than a diameter of the fibrous cup.

6. The apparatus of claim 1, wherein the frame further comprises:

a bore rearward disk;

a plurality of legs between the bore forward disk and the bore rearward disk, wherein the legs are configured to bend and press outward against the bore when the force to push the projectile down the bore is applied to the frame; and further comprising cleaning materials wrapped around the legs of the frame.

7. The apparatus of claim 6, wherein the cleaning materials comprise a cylindrically-shaped fibrous pad.

8. The apparatus of claim 7, wherein the fibrous pad comprises slots in an outer surface of the pad configured to clean a rifled bore.

9. The apparatus of claim 7, wherein the fibrous pad comprises notches in an outer surface of the pad configured to clean a rifled bore.

10. The apparatus of claim 6, wherein the cleaning materials comprise a rubberized wiper disk.

* * * * *